US007198822B2

(12) United States Patent
Steinwandt et al.

(10) Patent No.: US 7,198,822 B2
(45) Date of Patent: Apr. 3, 2007

(54) METHOD OF APPLYING SILICONE CAULKING COMPOUND

(76) Inventors: Donald Ervin Steinwandt, 52505 Range Road 222, Ardrossan, Alberta (CA) T8E 2G2; John Ruben Johnson, 121, 51248 Rge. Rd. 231, Sherwood Park, Alberta (CA) T8B 1K7

( * ) Notice: Subject to any disclaimer, the term of this patent is extended or adjusted under 35 U.S.C. 154(b) by 0 days.

(21) Appl. No.: 11/294,088

(22) Filed: Dec. 5, 2005

(65) Prior Publication Data

US 2006/0110539 A1 May 25, 2006

Related U.S. Application Data

(63) Continuation-in-part of application No. 10/712,667, filed on Nov. 13, 2003, now abandoned.

(30) Foreign Application Priority Data

Nov. 15, 2002 (CA) ..... 2411939

(51) Int. Cl.
*B05D 1/02* (2006.01)
*B05D 3/10* (2006.01)

(52) U.S. Cl. ..... 427/271; 427/333; 427/336; 427/337; 427/421.1

(58) Field of Classification Search ..... 427/258, 427/270, 271, 273, 277, 333, 336, 337, 340, 427/355, 421.1, 421.7, 407.1
See application file for complete search history.

(56) References Cited

U.S. PATENT DOCUMENTS 5,360,489 A * 11/1994 Gaul et al. ..... 134/42
5,863,884 A * 1/1999 Lafreniere ..... 510/412
6,656,886 B1 * 12/2003 Johnson ..... 508/179
6,838,426 B1 * 1/2005 Zeilinger ..... 510/417

FOREIGN PATENT DOCUMENTS

JP 58-149976 * 9/1983

* cited by examiner

*Primary Examiner*—William Phillip Fletcher, III
(74) *Attorney, Agent, or Firm*—Davis & Bujold, P.L.L.C.

(57) ABSTRACT

A method of applying a silicone caulking compound. A first step involves applying a bead of silicone caulking compound to a seam or surface. A second step involves spraying a surfactant on the bead of silicone caulking compound. A third step involves wiping excess silicone caulking compound from the surface. The surfactant applied to the surface "lubricates" the surface to prevent adhesion of the silicone caulking compound to the surface when excess material is wiped away, thereby preventing smearing.

3 Claims, 3 Drawing Sheets

METHOD OF APPLYING SILICONE CAULKING COMPOUND

This application is a continuation-in-part of Ser. No. 10/712,667, filed Nov. 13, 2003, now abandoned.

FIELD OF THE INVENTION

The present invention relates to method of applying a silicone caulking compound.

BACKGROUND OF THE INVENTION

The very properties which make silicone caulking compounds effective for caulking, make them difficult to apply with an attractive desired result. As silicone caulking compounds are tacky, they tend to stick to a surface. This property helps make an effective moisture seal. However, this same property tends to result in the silicone caulking compound being smeared over the seam or the sealing surface leaving a cosmetically unattractive finish.

SUMMARY OF THE INVENTION

What is required is a simpler method of applying silicone caulking compound to obtain a cosmetically attractive finish.

According to the present invention there is provided a method of applying a silicone caulking compound. A first step involves applying a bead of silicone caulking compound to a surface. A second step involves spraying a surfactant solution on the bead of silicone caulking compound. A third step involves wiping excess silicone caulking compound from the surface. The surfactant applied to the surface "lubricates" the surface to prevent adhesion of the silicone caulking compound to the undesired surface areas when excess material is wiped away, thereby preventing smearing.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
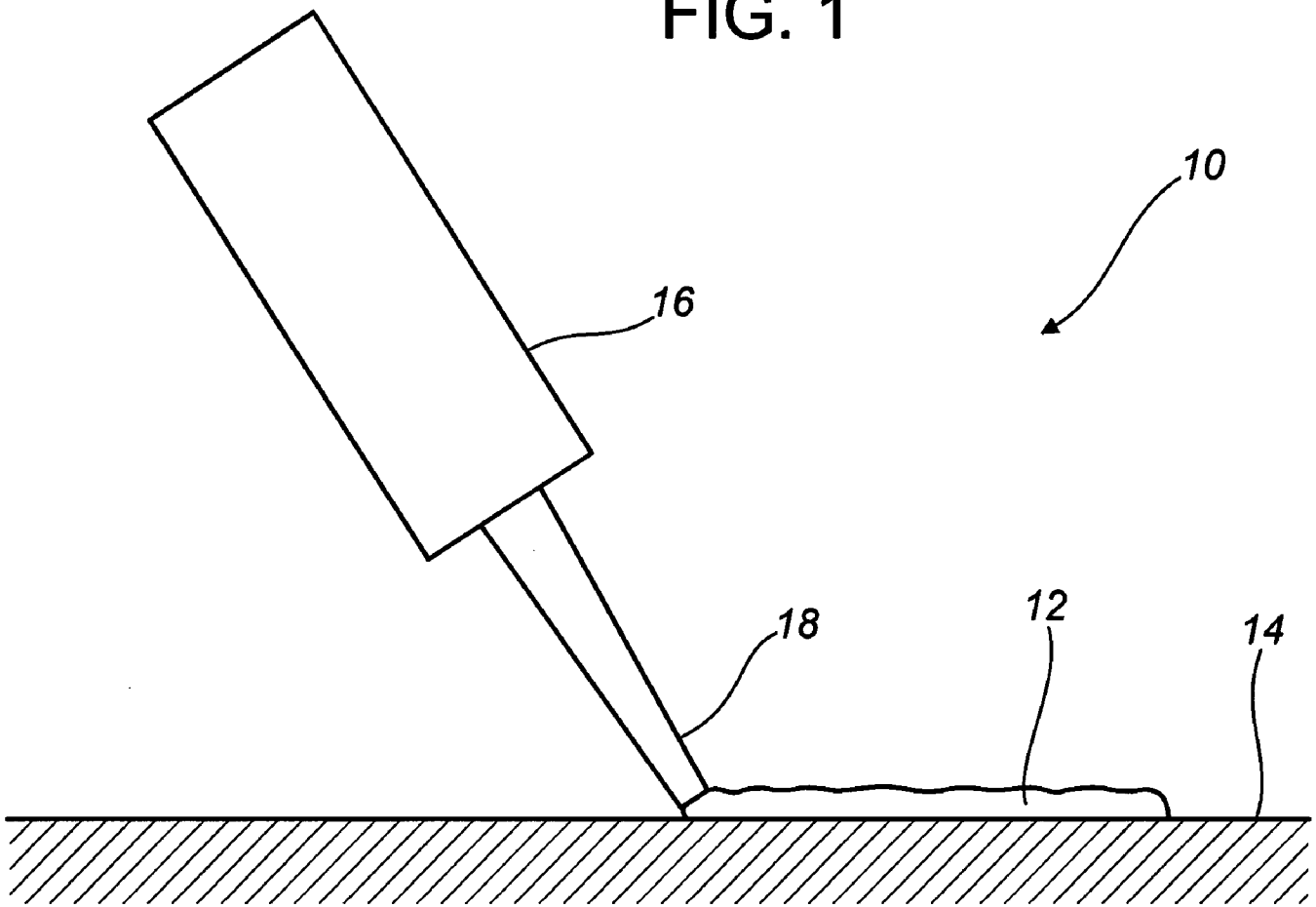
FIG. 1 is a perspective view of a method applying silicone caulking compound to a surface according to the teachings of the preferred method.

The preferred method will now be described with reference to FIGS. 1 through 3. Referring to FIG. 1, there is illustrated a method of applying a silicone caulking compound 10 which includes applying a bead of silicone caulking compound 12 to a surface 14. Surface 14 to which silicone caulking compound 12 is to be applied should be smooth, dry, and free of all debris, including any previous caulking prior before the application of silicone caulking compound 12. In the illustrated method 10, a caulking tube 16 with an application tip 18 is used for applying bead of silicone caulking compound 12, however it will be appreciated that a caulking gun could also be used.

Figure 2:
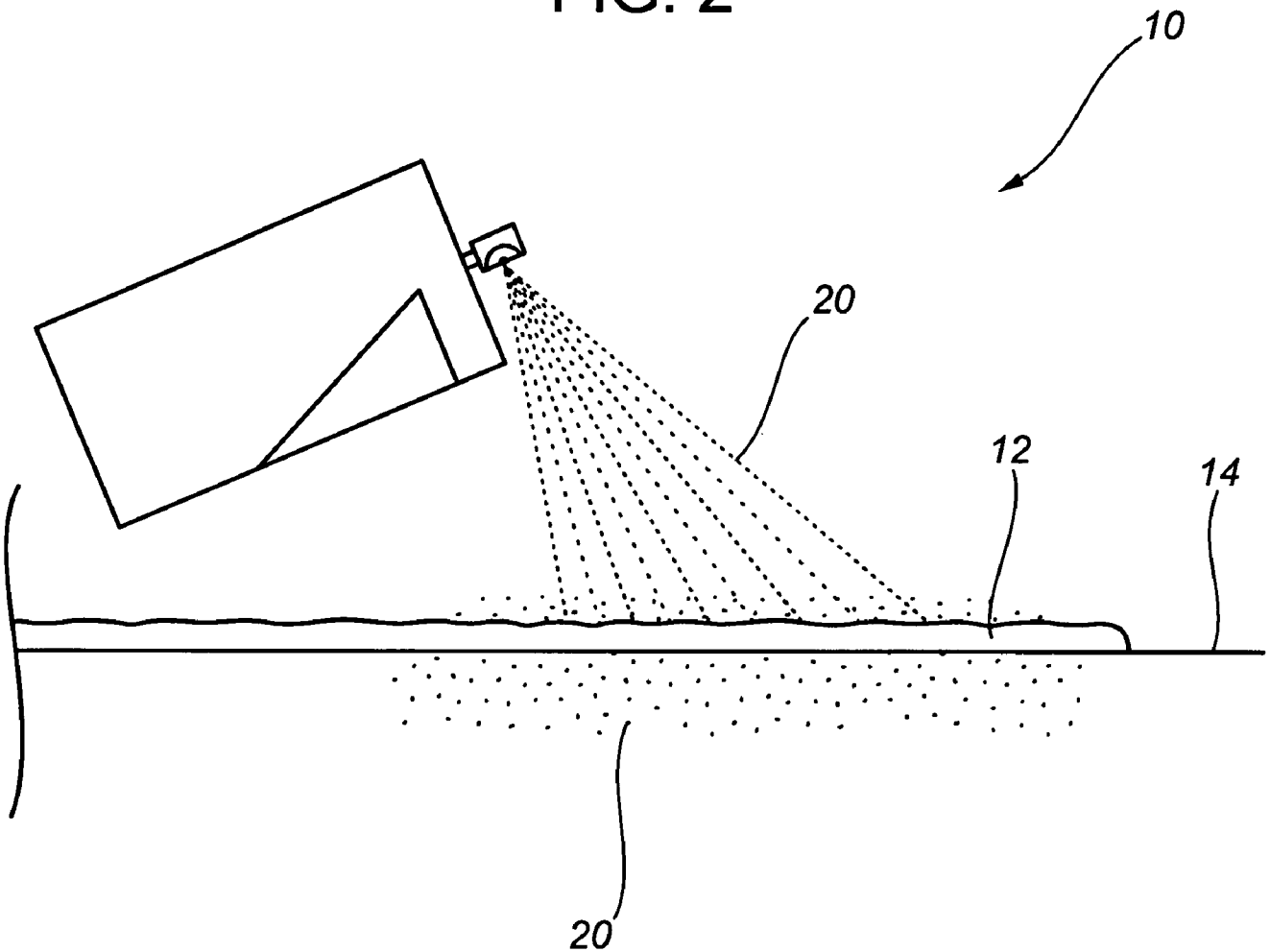
FIG. 2 is a perspective view of the method illustrated in FIG. 1, wherein a surfactant is sprayed on silicone caulking compound.
Figure 3:
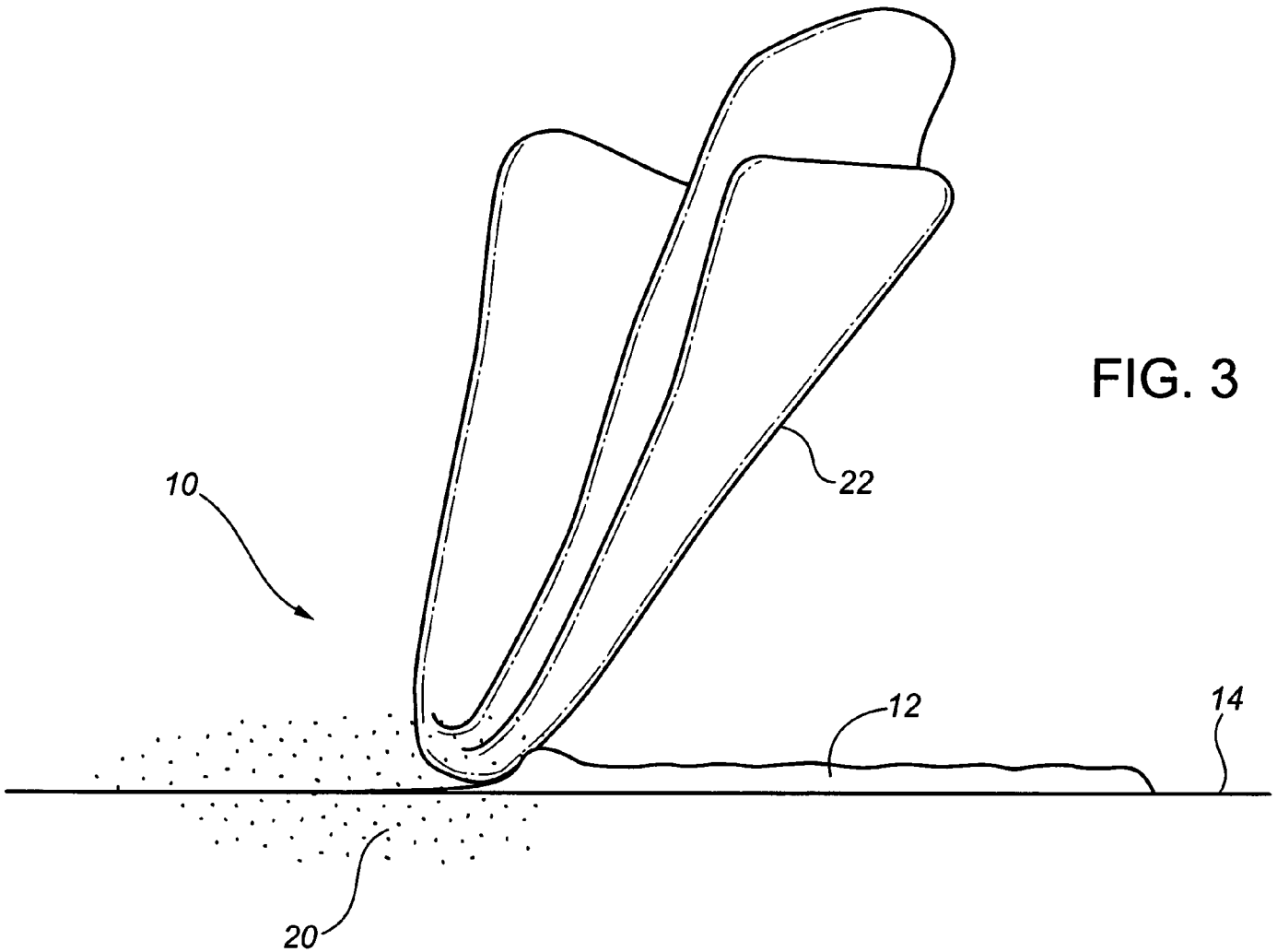
FIG. 3 is a perspective view of the method illustrated in FIG. 1, wherein excess silicone caulking compound is wiped from a surface.

Referring to FIG. 2, a surfactant 20 is sprayed on bead of silicone caulking compound 12 before bead of silicone caulking compound 12 begins to set. Referring to FIG. 3, after silicone caulking compound 12 has been sprayed with surfactant 20, excess silicone caulking compound 12 is wiped from surface 14. In illustrated method, a cloth 22 is used to wipe excess silicone caulking compound 12, however it will be appreciated that one could use a finger or other means could be used. It will also be appreciated that if silicone caulking compound is to be applied to a seam between two or more surfaces 14, then bead of silicone caulking compound 12 must come into contact with all of surfaces 14. No further silicone caulking compound 12 may be added after the spraying of surfactant 20. Silicone caulking compound 12 is then allowed to set for a period of 4 to 10 hours.

Use

The use of the method of applying a silicone caulking will now be described with reference to FIGS. 1 through 3. Referring to FIG. 2, with the method described above, surfactant 20 that is applied to surface 14 "lubricates" surface 14 to prevent adhesion of silicone caulking compound 12 to surface 14. Referring to FIG. 3, excess silicone caulking compound 12 may then be wiped away. Spreading out or smearing is prevented as silicone caulking compound 12 cannot adhere to surface 14 after it has been sprayed with surfactant 20. It will be appreciated that a finger or other wiping device could also be used to wipe excess silicone caulking compound 12. The excess silicone that is removed is not sticky or tacky and can be readily transferred, without mess, to a rag or paper towel for disposal.

Test Results

Surfactants are present in soaps and detergents. Often the word detergent is used interchangeably with surfactant. Surfactants are classified depending upon their charge. Anionic surfactants carry a negative charge. Cationic surfactants carry a positive charge. Nonionic surfactants are neutral, without either a positive or negative charge. In original formulations cationic surfactants were used with beneficial results. It was speculated that the positive charge of the cationic surfactants made them better suited for this particular application. The objective of this study was to evaluate anionic, cationic and nonionic surfactants at different concentrations for their beneficial effect in this application.

Silicone Caulking Material

The silicone caulking material used in this study was a standard white interior grade intended for bathroom applications. The product was manufactured by General Electric Co. and was used as received.

Ceramic Tile

The performance of the various surfactants as an aid in the application of silicon caulking was evaluated on three prepared surfaces. The surfaces were prepared by mounting a single row of ceramic tiles (~3" squares) near the edge of a wooden support. Two wooden supports were then attached so as to form a right angle between the ceramic tiles and to bring the ceramic tiles into close proximity. The length of the right angle space between the ceramic tiles was about 75 cm.

Three different surfaces were employed for the evaluation of the materials: tiles with a smooth ceramic surface, tiles with a smooth ceramic surface where the right angle corner between them had been covered with a layer of masking tape, and tiles which had a rough textured surface. The silicone caulking was then applied to the right angle space between the tiles using a manual applicator standard to the industry.

Before each experiment, the surface of the ceramic tiles was thoroughly cleaned with water followed by acetone. Fresh masking tape was used for each experimental surface involving masking tape.

Evaluation Procedure

Preliminary Observations—No Surfactant Applied

The silicone caulking was pumped, using the manual applicator, into the right angle area between the ceramic tiles. In this way a bead some ¼" in diameter or so was formed in the right angle space between the tiles. When the finger was used in an effort to smooth the silicone caulking, and thus remove excess silicone caulking, it was found that the silicone caulking stuck to the finger and was difficult to remove. In addition, the silicone caulking smeared onto the area of the ceramic adjacent to the right angle space where the silicone caulking had been applied and it was found to be difficult to remove the silicone caulking from this area. Finally, the surface of the resulting silicone caulking bead had a rough appearance. In summary, the procedure resulted in a final bead of unattractive appearance and it was difficult to remove excess caulking from tooling and the ceramic tile.

Observations—Surfactant Applied

In order to evaluate the beneficial effect of the various surfactant solutions on the application of the silicone caulking, the silicone caulking was applied to the surfaces as described above. The surfactant solution was then sprayed onto the area where the silicone caulking had been applied using a mist applicator of the type commonly used in the application of a window cleaner. This application covered the silicone caulking with surfactant solution along with adjacent areas of the ceramic tile. Typically excess surfactant solution was applied. Finally, the finger was used to smooth out the applied silicone caulking and the result noted.

Characteristics evaluated were as follows:

Ease of removal of excess silicone caulking from the finger

Smoothness of surface and uniformity of the resulting silicone caulking bead

Ease of removal of excess silicone caulking from areas of the ceramic tile surface near the final bead.

Surfactant Solutions

In order to evaluate various surfactants for their beneficial or otherwise effect on applying silicone caulking materials, aqueous solutions of a number of different types of surfactants were prepared in de-ionized water. The surfactants used in this study are listed in Table 1 below along with the suppliers of the surfactants. Table 2 summarizes the surfactant concentrations evaluated, and the observations of the beneficial or otherwise effect of the surfactant solution on the removal of excess silicon caulking material from the ceramic tile and fingers, and the final appearance of the silicone bead.

TABLE 1

Surfactants used in this investigation

| Designation of Surfactant | Surfactant Description from Supplier | Supplier |
|---|---|---|
| Cationic | BTC 824 Myristalkonium chloride Alkyl (60% $C_{14}$, 30% $C_{16}$, 5% $C_{12}$, 5% $C_{18}$) dimethyl benzylammonium chloride 50% Active Liquid | Stepan Co. |
| Anionic | Sodium dodecyl sulfate | Fisher Chemical Co. |
| Non-Ionic | Igepal CO-630, a nonylphenol ethoxylate | Stepan Co. |

Results of Evaluation

Surfactant solutions of 0.1%, 0.3% and 1.0% by weight of as received surfactant in de-ionized water were prepared. Three different surfactants, as outlined in Table 1, were used. The resulting nine solutions were evaluated for their beneficial effect on the application of silicone caulking on the three different surfaces described above. The results of these examinations are summarized Table 2 below.

TABLE 2

Results of Evaluation of Beneficial Effect of Surfactants on the Application of Silicone Caulking to a Ceramic Surface

| Surfactant | Concentration | Observations |
|---|---|---|
| Non-ionic | 0.1% | Good performance but not the best. On tape there was some 'feathering' and residue of the silicone caulking. On the finger, some difficulty was experience in the removal of excess silicone caulking. |
| Non-ionic | 0.3% | Very good performance on all three surfaces. Comes off the finger easily. Excess silicone caulking is easily removed from the tile surface. |
| Non-ionic | 1.0% | Excellent performance on all three surfaces: tape, smooth ceramic and rough ceramic. Excess silicone caulking was easily removed from the finger and from the surface of tile using a paper towel. The resulting silicone caulking bead was judged to have a uniform appearance with an excellent cosmetic appearance. It was agreed by all that the performance of this surfactant mixture left little if anything to be desired. Very smooth application. |
| Cationic | 0.1% | Silicone ends to smear on the tile surface. Poor performance compared to other mixtures. |
| Cationic | 0.3% | May be better than the 1% cationic solution below. Not optimum however. |
| Cationic | 1.0% | Tendency to smear. Doesn't re-work as easily as some of the others. Not optimum. |
| Anionic | 0.1% | Some feathering on the tile surface. Comes off finger well. On re-tooling or re-working the silicone caulking bead, there is a tendency to smear. |
| Anionic | 0.3% | Works very well but not quite as good as the 1% non-ionic. Seems to stick to the finger more. |
| Anionic | 1.0% | Excellent performance on all surfaces. Very similar in performance to the 1% non-ionic mixture. |

SUMMARY AND CONCLUSIONS

Both the non-ionic surfactant and the anionic surfactant were found to have a beneficial effect on the application of the silicone caulking to all three surfaces. The cationic surfactant was found to have the least beneficial effect for the application of silicone caulking of all three surfactants at the concentration range investigated. What this means for a tradesman is that all three types of surfactant will work. The tradesman can mix any commercially available soap or detergent containing a surfactant with water and obtain the benefits of the above described method without worrying as to the particular "type" of surfactant to be used. If purchasing a surfactant from a chemical store, it would appear that a non-ionic or anionic surfactant is to be preferred.

In summation, it is to be understood that virtually any currently available household cleaner, detergent or soap would be suitable for use as the surfactant in accordance with the inventive method discussed above. The surfactant found in the following currently available household cleaners, such as WINDEX™, MR. CLEAN™, LYSOL™, FANTASTIK™, FORMULA 409™, for example, would be suitable for practice of the inventive method. It is to be appreciated that the important aspect of the surfactant is that it be in a flowable or spreadable state, e.g., liquid, gel, paste or some other non-solid form, so that it can be sprayed, dispensed, roller, brushed or otherwise applied to the desired surface, after application of the bead of caulk, and prevent the bead of caulk from adhering to undesired portion(s) of the surface when the excess caulk is wiped from the surface.

While any amount of surfactant has beneficial effects, the optimum concentration for beneficial effects of the non-ionic and anionic surfactants appears to be ~1% in water. There is only a minor improvement in beneficial effect in going from 0.3% to 1.0% for the non-ionic and anionic surfactant, but a substantial difference in beneficial performance was noted from the corresponding 0.1% solutions. Increasing the amount of surfactant beyond 1% is not believed to sufficiently improve performance to warrant the increase cost.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A method of applying a silicone caulking compound to a surface, the method comprising the steps of:

applying an unset end uncured bead of silicone caulking compound to a surface;

spraying a surfactant solution on the applied bead of silicone caulking compound and on an area of the surface adjacent the applied bead of silicone caulking compound prior to setting of the applied bead of silicone caulking compound;

prior to setting of the applied bead of silicone caulking compound, wiping excess silicone caulking compound from the surface while leaving a remaining portion of the applied silicone caulking on the surface with the surfactant solution sprayed on the area of the surface adjacent the applied bead of silicone caulking compound lubricating the surface to prevent smearing of the unset and uncured excess silicone caulking compound to the surface and facilitate removal thereof; and allowing the remaining portion of the applied silicone caulking compound to set on the surface.

2. The method as defined in claim 1, the surfactant solution containing approximately 1% surfactant in water, as expressed as a percentage by weight of the surfactant solution.

3. The method as defined in claim 1, the surfactant solution containing at least 0.03% surfactant in water, as expressed as a percentage by weight of the surfactant solution.

* * * * *